United States Patent [19]

Bondra, Jr. et al.

[11] 3,979,245

[45] Sept. 7, 1976

[54] INSULATION BLANKET AND METHOD AND APPARATUS FOR MAKING SAME

[75] Inventors: John Bondra, Jr., Macedonia; William R. Ruhling, Northfield, both of Ohio

[73] Assignee: Metal Buildings Insulation, Inc., Brooklyn Heights, Ohio

[22] Filed: Mar. 7, 1975

[21] Appl. No.: 556,283

Related U.S. Application Data

[62] Division of Ser. No. 421,345, Dec. 3, 1973.

[52] U.S. Cl. ..... 156/184; 156/191; 156/257; 156/446; 156/510

[51] Int. Cl.[2] ..... B65H 81/00

[58] Field of Search ..... 156/184, 191–193, 156/211, 257, 268, 62.6, 443, 446, 510, 516; 242/55.1, 1; 427/179; 428/75, 134, 136, 160, 906; 52/388, 406; 206/321, 417

[56] References Cited

UNITED STATES PATENTS

| | | | |
|---|---|---|---|
| 2,681,702 | 6/1954 | Kuenn et al. | 156/184 X |
| 3,084,403 | 4/1963 | Elmendorf | 206/321 X |
| 3,432,373 | 3/1969 | McMahon | 156/184 |

*Primary Examiner*—David A. Simmons
*Attorney, Agent, or Firm*—McNenny, Pearne, Gordon, Gail, Dickinson & Schiller

[57] ABSTRACT

An insulating blanket is disclosed in which a semi-rigid mat of glass fibers is bonded on one side to a facing material. Lateral cuts are formed in the mat extending from the opposite side thereof toward the side on which the facing is bonded. Such cuts allow the facing to bend with a hinge-like manner when the insulating blanket is rolled, permitting the lamination of the facing and mat and the rolling of the laminate prior to the setting of the adhesive. The preferred method and apparatus for forming such insulating blanket is also disclosed.

15 Claims, 5 Drawing Figures

INSULATION BLANKET AND METHOD AND APPARATUS FOR MAKING SAME

This is a division, of application Ser. No. 421,345 filed Dec. 3, 1973.

BACKGROUND OF THE INVENTION

This invention relates generally to insulation blankets and more particularly to a novel and improved semi-rigid insulating blanket for metal buildings or the like and to a method and apparatus for manufacturing such blankets.

Prior Art

Insulation blankets having a facing sheet along one side thereof are commonly used to insulate metal buildings or the like. Such blankets are usually stretched over the building frame and, while the blankets are tightly stretched, the exterior wall or roof material is secured to the building frame over the insulation. The U.S. Letters Pat. No. 3,121,649 describes one such method for installing such insulation and is incorporated herein by reference.

Such insulation blankets are formed of a limp mat of loose glass fibers with a sheet of facing material adhered to one side thereof. In order to provide a neat installation in which the exposed facing is smooth and does not sag, it has usually been necessary to stretch the blanket in place. Such stretching creates additional labor costs and, when improperly performed, causes an inferior installation.

In order to eliminate the necessity of stretching the blanket, a semi-rigid blanket structure has been developed which can be rolled or compressed, but which has spring-back tending to cause the blanket to assume its normal flat uncompressed position. Such blanket structure includes a loose mat of glass fibers impregnated with a type of resin which causes the fiber mat to have an elastic memory which produces a spring-back function. When such material is laminated with a facing to form a blanket, it is not necessary to stretch the blanket over the metal framing of the building, since the blanket has sufficient rigidity to provide a smooth, nonsagging installation.

Such semi-rigid blankets are shipped and handled in rolls before installation. In order to provide a smooth facing when the blanket is unrolled, it has been necessary to laminate the facing and the mat with an adhesive while both are flat and to set the adhesive before the blanket is rolled for shipment.

The following is a list of prior art patents relating generally to the subject matter of this application:

| Patent No. | Date of Patent | Inventor |
|---|---|---|
| 2,056,180 | October 6, 1936 | Flood |
| 2,653,358 | September 29, 1953 | MacDonald |
| 2,715,596 | August 16, 1955 | Hawley |
| 3,031,358 | April 24, 1962 | Rutter, et al |
| 3,077,059 | February 12, 1963 | Stout |
| 3,084,403 | April 9, 1963 | Elmendorf |
| 3,279,139 | October 18, 1966 | Stahlhut |
| 3,420,365 | January 7, 1969 | Bailey |
| 3,717,247 | February 20, 1973 | Moore |

SUMMARY OF THE INVENTION

In accordance with the present invention, a novel and improved blanket structure is provided in which the lamination of the facing to a semi-rigid fiber mat is performed with an adhesive which does not set until after the laminate is rolled for shipment or the like. In accordance with the illustrated embodiment of this invention, the facing material is coated with a liquid adhesive, for example a water-based latex adhesive, is pressed into contact with the semi-rigid mat, and is rolled before the adhesive drys or sets. The blanket structure is arranged, however, so that when the blanket is unrolled and assumes its flat uncompressed position, the facing is smooth.

In the illustrated embodiment of this invention, the semi-rigid mat is laterally cut from the face of the mat opposite the face on which the facing is laminated at regular intervals. The cuts preferably extend toward the laminating face at least two-thirds of the thickness of the mat so that the mat tends to bend in a hinge-like manner about a center of bending substantially adjacent to the facing. The blanket assembly including the laterally cut mat and the facing are rolled for handling and shipment before the adhesive at the interface therebetween is allowed to set. However, because of the hinge-like bending of the blanket during the rolling operation, there is little or no sliding action tending to cause an uneven surface on the facing when the blanket returns to its normal flat condition. Upon being released from the roll, the blanket springs back to its flat condition and the cuts are closed. The assembled blanket provides sufficient rigidity to assure that it remains in a flat and nonsagging position when it is installed even though stretching of the blanket is not required.

DETAILED DESCRIPTION OF THE DRAWINGS

Figure 1:
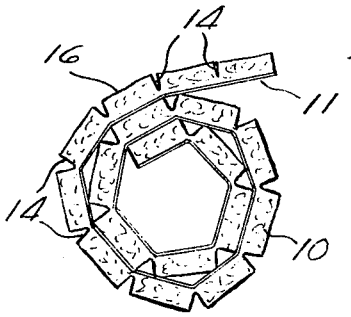
FIG. 1 is a side elevation illustrating a preferred embodiment of a blanket in accordance with the present invention with a portion of the blanket rolled.
Figure 2:
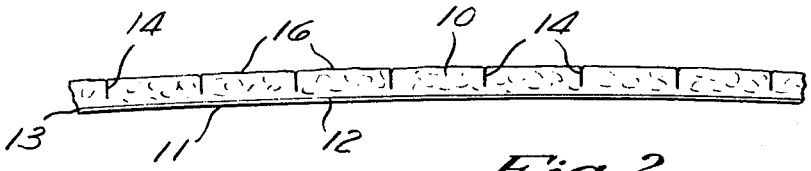
FIG. 2 is a side elevation illustrating the position the blanket of FIG. 1 assumes when it is unrolled and is in its free state.

FIGS. 1 and 2 illustrate the preferred insulation blanket in accordance with this invention, in the rolled position and the flat position, respectively. The blanket includes a mat 10 of loose glass fibers which are treated with a resin which tends to lock the fibers with respect to each and to produce a mat which is semi-rigid. Such mat has spring-back urging the mat toward a flat uncompressed condition as illustrated in FIG. 2. Such mat can be compressed, rolled, or otherwise deformed from its flat uncompressed position, but the mat has an elastic memory which tends to cause it to spring back to its uncompressed, flat condition as soon as it is released. This mat differs from the conventional mat which is also formed of loose glass fibers with a resin binder. However, the conventional blanket does not have appreciable spring-back and is sufficiently limp so that it will not support itself in a flat condition between two spaced supports.

The semi-rigid insulation mats may be obtained from suppliers such as Owens Corning Fiberglas Corp. of Toledo, Ohio.

The blanket is provided with a facing sheet 11 which is secured to the mat 10 along one side 12 thereof by an adhesive. A water-base latex adhesive may be used for this purpose. Such facing 11 functions to provide a vapor barrier to resist vapor penetration into the mat 10 when the insulation is installed. In addition, when the insulation is installed in a typical metal building, the facing is exposed to the interior of the building and is therefore usually formed of a material having an attractive appearance. The facing can be of any one of a number of different types of material. For example, the facing may include an aluminum foil which is reinforced by a scrim craft material or may be a simple vinyl sheet. In some instances, the facing may be a reinforced vinyl scrim foil which combines the attractive appearance of vinyl with the excellence of foil as a vapor barrier. In accordance with the method of the present invention, the facing material 11 is secured to the face 12 of the mat 10 by a liquid adhesive 13 which is applied to the facing material before it is brought into contact with the mat 10.

Figure 1A:
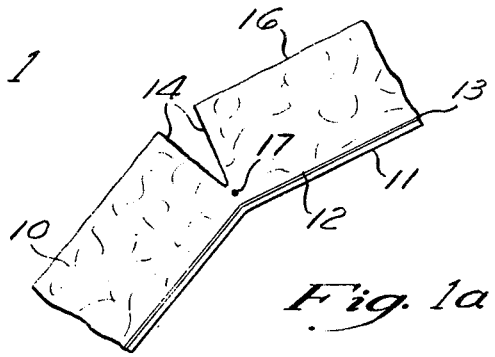
FIG. 1*a* is an enlarged fragmentary view illustrating the hinge-like bending of the blanket.

The mat 10 is formed with laterally extending cuts 14 at intervals along the length thereof extending from the side 16 opposite the facing 11 in a direction toward the facing. These cuts 14 are formed in a manner discussed in greater detail below. When the blanket is rolled, the cuts cause the blanket to bend in a hinge-like manner about a center 17 substantially adjacent to the side 12 of the blanket. If the cuts 14 were not formed in the blanket, the blanket would tend to bend during rolling about a center plane substantially half-way between the faces 12 and 16. The cuts are preferably formed so that they extend through at least two-thirds of the thickness of the blanket so that the hinge-type bending illustrated in FIG. 1*a* tends to occur about a hinge center 17 which is substantially adjacent to the innerface 12 of the mat 10. When the bending occurs, the notch 14 opens as best illustrated in FIG. 1*a*, and the portions of the mat between adjacent notches 14 tends to be substantially straight.

Because the hinge center or center of bending 17 is substantially adjacent to the face 12, the facing 11 does not slide appreciably with respect to the face 12 during the rolling of the blanket. Consequently, the length of the innerface remains substantially the same in either the rolled or flat condition with the result that the facing remains smooth when the blanket is returned to its flat condition after the adhesive drys or sets in the rolled condition.

If the facing and mats were rolled without forming the notches, the bending would tend to occur about a central plane. Consequently, without the cuts or notches 14, slippage occurs between the facing 11 and the innerface 12 of the blanket during the rolling operation while the adhesive is still in its unset liquid condition. Unrolling of the blanket formed without the notches then results in an uneven wrinkled appearance of the facing with the result that the blanket does not provide an attractive smooth appearance in the installed condition.

Figure 3:
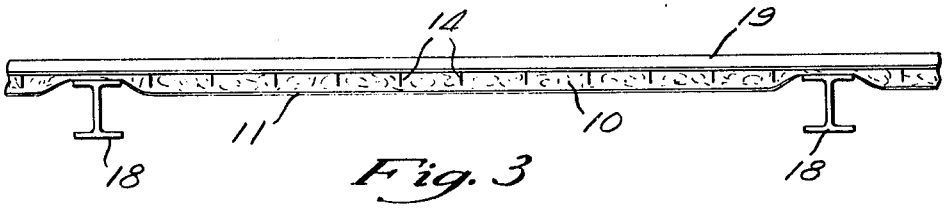
FIG. 3 is a side elevation illustrating a typical installation of a blanket in accordance with this invention.

In the roll the mat tends to bend at the cuts and remain substantially straight between cuts. When the blanket of FIG. 1 is unrolled, it assumes the position of FIG. 2 with the facing 11 substantially smooth. Consequently, the blanket of this invention can be installed between the metal framing and the exterior metal siding of a metal building as illustrated in FIG. 3. In practice, the blanket is unrolled and assumes a substantially flat position as illustrated in FIG. 2 due to the springback of the mat 10. The facing is then positioned over the framing or purlins 18 of a metal building with the facing 11 against the purlins and an exterior metal panel 19 is secured in position over the insulating blanket. It should be recognized that in fastening the exterior panels 19 to the purlins 18, the blanket is compressed at the location of the purlins.

Because the blanket mat 10 is semi-rigid, the blanket assumes a straight or flat condition when it is installed, and it is not necessary to stretch the blanket before installation of the exterior panel even on roofs since the semi-rigid nature of the mat prevents sagging of the blanket without stretching. In practice, it has been found that the blanket, after unrolling, tends to assume a slight lengthwise curve as illustrated in FIG. 2. However, when the exterior panel is fastened over the blanket, it assumes a fully straight position. The cuts 14 close when the blanket is unrolled to the flat condition so that the blanket's insulating properties are not adversely affected in any way.

Figure 4:
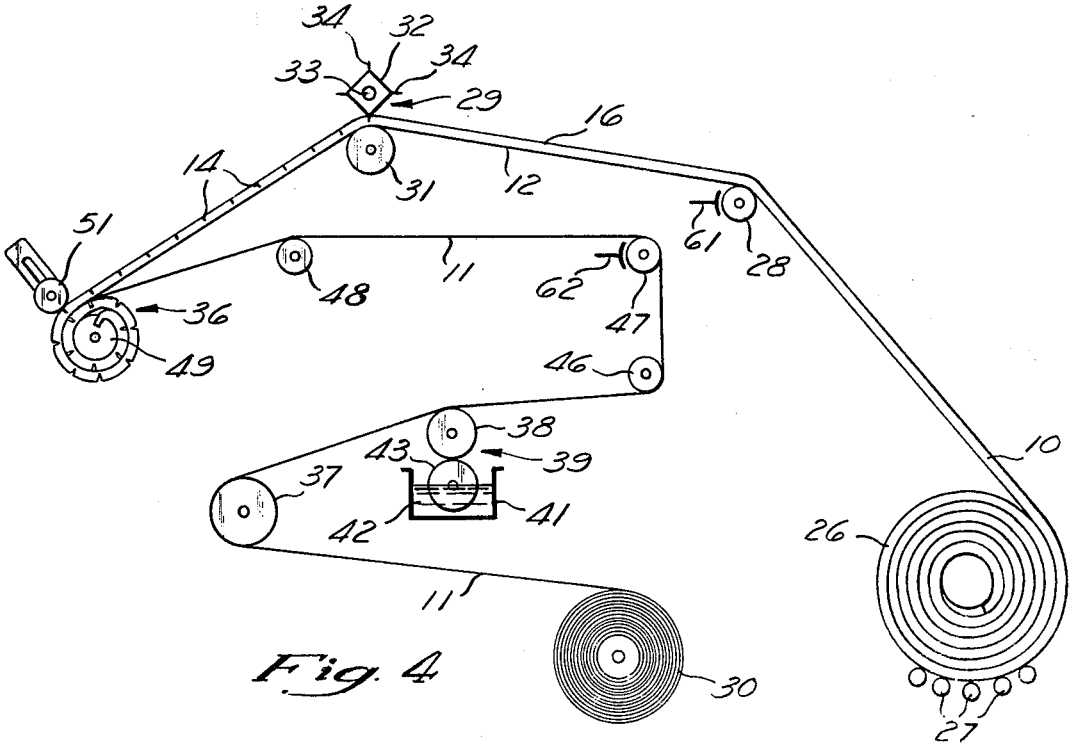
FIG. 4 is a schematic illustration of a machine for forming a blanket of the type illustrated in FIGS. 1 through 3.

The blanket of FIGS. 1 through 3 is preferably formed by a machine as schematically illustrated in FIG. 4. In such a machine, a supply roll 26 of semi-rigid mat 10 is supported on roller supports 27 so that it can be unwound during the manufacture of the blanket. A supply roll 30 of facing material 11 is also supported by the machine frame (not illustrated). The mat 10 passes over a guide roll 28 to a cutter station 29. Located at the cutter station 29 is a backup roll 31 and a rotating cutter 32. The cutter 32 is journaled for free rotation about its axis 33 and is provided with a knife cutter 34 at each of the four corners of the cutter. As the blanket mat 10 is pulled over the backup roll 31, the roll 31 and the cutter 32 rotate causing the cutter knives 34 to engage the side 16 of the mat and form evenly spaced cuts 14 in the mat extending from the side 16 toward the side 12.

In the illustrated embodiment, the cutter 32 is sized to provide a lateral cut 14 about every four inches along the length of the mat which extends toward the side 12 through a distance at least equal to about two-thirds of the thickness of the mat 10. The depth of the cut, of course, can be changed by changing the spacing between the axes of the roll 31 and the cutter 32. From the cutter station 29, the blanket is pulled to a coiling or rolling station at 36.

The facing 11 is pulled off of the roll 30 and passes over an idler roll 37. From the idler roll 37, the facing passes over the upper roll 38 at an adhesive applying station 39. A reservoir 41 is provided with liquid adhesive 42. A pickup roll 43 is journaled for rotation within the reservoir 41 so that its surface passes through the adhesive. The upper surface of the pickup roll 43 engages the transfer roll 38 and provides a coating of the liquid adhesive on the transfer roll. As the two rolls 38 and 43 are rotated by the movement of the facing 11, a thin coating of adhesive is uniformly applied to the adjacent side of the facing.

From the transfer roll 38 the facing passes over three idler rolls 46, 47 and 48 all of which engage the side of the facing which is not coated with adhesive. From the idler roll 48, the facing passes to the rolling station where it engages the side 12 of the mat and is rolled with the facing on the inside. Normally, the pick-up roller 43 and the roller 49 on which the roll of blanket is formed are powered and are the only powered portions of the machine. A floating roll 51 is positioned on the outside of the roll to engage the side 16 of the mat to ensure that proper engagement is provided between the mat surface 12 and the facing 11.

It should be clear that the adhesive coating at the interface of the facing 11 and mat 10 has not set at the time the blanket is rolled. The adhesive sets while the blanket is in the rolled condition in which it is stored, shipped and handled. By the time the blanket is unrolled, the adhesive has set and a good bond is maintained between the facing and the mat.

In some instances, it may be desirable to provide a pair of presser rolls immediately ahead of the coiling or rolling station to press the facing 11 and blanket 10 into tight engagement before the blanket is rolled. Adjustable drag means, schematically illustrated at 61 and 62, are provided to adjust the tension in the mat 10 and facing 11, respectively. Such adjustments are used when necessary to provide a smooth facing on the finished blanket.

Because the blanket tends to bend with a hinge-like action as best illustrated in FIG. 1*a*, substantially no slippage occurs between the facing and the adjacent surface 12 of the mat 10 during the rolling operation. Consequently, when the blanket is unrolled after the adhesive has set, the facing is smooth and provides a desirable appearance. Further, because the cuts close when the blanket is unrolled, the completed blanket has substantial resistance to bending in the direction of the facing. Consequently, the blanket does not sag even when it is installed on the roof of a building. With the present blanket, the cuts permit easy bending of the blanket in the direction of rolling, but do not materially decrease the resistance to bending in the opposite direction.

With the present invention, it is possible to laminate the facing to the mat and roll the assembly while the adhesive is still wet and unset. Consequently, it is not necessary to provide a curing or drying operation while the blanket is in the flat condition. Therefore, the extra cost in both machinery and labor of providing for the drying of the adhesive while the blanket is flat is eliminated by the present invention, and it is possible to produce an effective blanket with a minimum of labor and equipment.

Although a preferred embodiment of this invention is illustrated, it is to be understood that various modifications and rearrangements of parts may be resorted to without departing from the scope of the invention disclosed.

What is claimed is:

1. A method of laminating a blanket having a facing on one side of an elongated insulation body formed of a loose fiber mat which is bendable and provides spring-back tending to cause it to assume a normal flat and uncompressed position in which the facing is substantially smooth comprising forming a plurality of lateral cuts in said body extending toward said one side from the opposite side thereof, engaging said facing with said one side with an intermediate layer of unset adhesive, rolling said facing and body with said facing inside and allowing said adhesive to set while in such rolled condition.

2. A method of laminating a blanket in accordance with claim 1 wherein said adhesive is applied to said facing before it engages said mat.

3. A method of laminating a blanket in accordance with claim 1 wherein the tension in said facing and mat is adjusted to cause said facing to be smooth when the blanket is unrolled to a flat condition.

4. A method of laminating a blanket in accordance with claim 1 wherein said cuts are formed in said mat without removing any mat material so that said cuts close when said blanket is unrolled.

5. A method of laminating a blanket in accordance with claim 1 wherein said lateral cuts are cut at least substantially two thirds of the way through said body but terminated at a location spaced from said one face.

6. A machine for laminating an insulating body of compressible and bendable material having springback with a facing comprising first support means for a supply roll of an elongated insulation body, second support means for an elongated roll of facing, power means operable to feed said facing and said body to a laminating position in which said facing is pressed against one face of said body, means applying adhesive to the interface between said body and facing, a cutter operating to form a plurality of regularly spaced lateral cuts in said body extending from the face opposite said one face toward said one face partially through said body and leaving an uncut body portion connecting the portions of said body on each side of each cut, and means for rolling said body and facing with said facing inside before said adhesive sets causing said body to bend with a hinge-like action at each cut which causes each cut within the roll to open.

7. A machine for laminating an insulating body in accordance with claim 6 wherein said cutter is journalled on said machine for rotation about an axis extending laterally with respect to said body, and reaction means operate to hold said body against said cutter as said body moves through said cutter.

8. A machine for laminating an insulating body in accordance with claim 7 wherein said cutter operates without interrupting the movement of said body through said cutter.

9. A machine for laminating an insulating body as set forth in claim 8 wherein said cutter operates without producing substantial variations in the tension of said body at said laminating position.

10. A machine for laminating an insulating body in accordance with claim 6 wherein said cutter operates to cut at least substantially two thirds of the way through said body but to a location spaced from said one face.

11. A machine for laminating an insulating body in accordance with claim 6 wherein said means for applying adhesive operates to coat said facing with adhesive before said facing and said body are engaged.

12. A machine for laminating an insulating body in accordance with claim 6 wherein said cutter operates to cut said body before said facing and said body are engaged.

13. A machine for laminating an insulating body in accordance with claim 12 wherein said means for applying adhesive operates to coat said facing with adhesive before said facing and said body are engaged.

14. A machine for laminating an insulating body in accordance with claim 6 wherein means are provided to adjust the tension in said facing and body when they are rolled.

15. A machine for laminating an insulating body in accordance with claim 6 wherein said power means operates said means for rolling said body and facing to pull said facing and body through the machine.

* * * * *